US005732519A

United States Patent [19]

Leek

[11] Patent Number: 5,732,519

[45] Date of Patent: Mar. 31, 1998

[54] ONE PIECE FOUNDATION-TO-FRAME CONNECTION

[75] Inventor: William F. Leek, Anaheim, Calif.

[73] Assignee: Simpson Strong-Tie Company, Inc., Pleasanton, Calif.

[21] Appl. No.: 688,312

[22] Filed: Jul. 30, 1996

[51] Int. Cl.[6] ..... E04B 1/38

[52] U.S. Cl. ..... 52/293.3; 52/274; 52/295; 52/698; 52/712

[58] Field of Search ..... 52/274, 277, 264, 52/293.1, 293.3, 294, 295, 698, 712, 714

[56] References Cited

U.S. PATENT DOCUMENTS

| | | | |
|---|---|---|---|
| 2,260,105 | 10/1941 | Hasenburger et al. | 52/295 X |
| 2,903,879 | 9/1959 | Williams | 52/293.3 X |
| 4,570,403 | 2/1986 | Dannemiller | 52/295 |
| 5,072,570 | 12/1991 | Johnson . | |
| 5,150,553 | 9/1992 | Commins et al. . | |
| 5,160,211 | 11/1992 | Gilb | 52/712 X |
| 5,249,404 | 10/1993 | Leek et al. . | |
| 5,274,981 | 1/1994 | Commins | 52/712 |
| 5,419,649 | 5/1995 | Gilb | 52/712 X |
| 5,513,476 | 5/1996 | Jones . | |

OTHER PUBLICATIONS

Simpson Strong-Tie Co., Inc. Catalog on "Earthquake-Resistant Construction Connectors"Copyright 1996 #C-EQ96.

Harlen metal products, inc. Brochure, Earthwuake Retrofit Products for Wood Frame Buildings, 4 pages, 1994.

*Primary Examiner*—Wynn E. Wood
*Assistant Examiner*—Laura A. Callo
*Attorney, Agent, or Firm*—James R. Cypher

[57] ABSTRACT

A one piece foundation-to-frame member connection for retrofit attachment of a wood building frame member such as a sill plate to a foundation. The connection is particularly useful where the mudsill plate was not initially anchored to the foundation by threaded anchor bolts or other metal connectors or the original anchoring installation was insufficient to give the necessary anchorage to resist uplift of the frame from the foundation by earthquake, high winds, floods or tidal activity. A uniquely S-shaped configured connector having roughly the shape of the front panel of a horse drawn sleigh is preferably attached to the sill plate by lag screws and to the foundation with threaded bolts inserted into epoxy filled drilled holes. All attachments are from the inside of the foundation at a generally horizontal or at a slight angle where the inside face of the foundation is slanted. By forming all fastener openings as slots in curved portions of the connector, the connector may be installed where the inner face of the foundation is vertical or slanted. The connection may be effected where the mudsill plate overhangs the inside face of the foundation to inset several inches and all points in between.

4 Claims, 6 Drawing Sheets

ONE PIECE FOUNDATION-TO-FRAME CONNECTION

BACKGROUND OF THE INVENTION

This invention relates to a connection for attaching a mudsill in a completed structure or other frame member of a building structure to an existing foundation, by means of a one piece foundation plate. Specifically, this invention relates to a retrofit connection where the existing building was constructed without attaching the sill plate to the foundation by anchor bolts or other means of attaching the sill plate to the concrete foundation.

Earthquakes, hurricanes, tornadoes, floods or tidal action impose upward as well as lateral forces on a building structure that can lift it off its foundation. To counteract uplift and lateral forces, it has become standard practice to tie or anchor the structure to its concrete foundation.

Earthquake damage assessments show that a lack of foundation to frame connectors is one of the two main earthquake failure modes for residential wood structures.

One of the first commercially accepted practices for anchoring a building structure to its foundation was to attach the horizontal frame member or mudsill to threaded anchor bolts embedded in the upper surface of the concrete foundation. There have been many inventions teaching improvements on this method. See U.S. Pat. No. 5,249,404, granted Oct. 5, 1993 to William F. Leek and Alfred D. Commins (patent teaching a connection formed with a metal holdown connector between the anchor bolt and a vertical frame member of the building structure). See U.S. Pat. No. 5,510,553, granted Sep. 29, 1992 to Alfred D. Commins and Ernest A. Romeo (patent teaching a connection formed with a strap that combines a holdown connector which attaches to a vertical frame member and an anchoring means which is embedded in the foundation to form a single piece for easier installation). However, these improved methods as well as the earlier method are not easily or economically adapted to connecting a completed building structure to its foundation. First, these connections require the anchor to be set when the foundation is poured. Secondly, they call for an anchor that protrudes from the upper surface of the foundation which is best installed before the building structure is constructed on the foundation.

The purpose of the present invention is to easily and economically form a strong connection between a frame member of a completed building structure and the foundation on which it rests.

Retrofit work imposes two major difficulties on the builder. The builder must add the connection to an existing structure and he must work in what is very often a cramped space underneath the building structure. The ease with which this connection can be formed despite these difficulties is important to its economic success, and, in fact, the ease of installation of the connection may be determinative as to whether the retrofit work will be done at all. This is especially true for crawl space foundations, where it is not uncommon that the installer will find himself slithering around on his belly in the dirt amid the black widow spiders and every imaginable type of refuse left by the workman who built the original house, including nails, screws, glass, pieces of wire, stones, pieces of concrete, and pieces of plasterboard.

The first specific problem in such retrofit work is that access to the top face of the foundation is restricted since the frame member sits on it and there is usually little clearance between other members of the building structure, such as floor joists, and the top face of the foundation. Thus there is a great need for methods for retrofitting that allow the workman to install the anchoring means to the exposed side face of the foundation rather than the top face of the foundation. It is also important than all connections to the mudsill or other frame member be in a horizontal direction with no need to hold the installing tools vertically or even at a steep angle.

Secondly, the dimensions of frame members and foundations are rarely uniform. The width of the frame member and the width of the foundation will vary. While it is usual to expect that the frame member, such as the mudsill, will be thinner than the foundation, it is not uncommon to find structures where the mudsill member is wider than the foundation and overhangs the foundation.

Thirdly, it has been found that in a substantial number of buildings, the mudsill is incorrectly installed on the foundation so that it overhangs the foundation.

Thus an economically viable solution for making this connection as a retrofit, must be able to adapt easily to the differing dimensions and construction practices.

Finally, because the dimensions of frame members and foundations are variable within even a single building structure, the installer will have to individually adjust each connector to fit the dimensions of the frame member and the foundation while he is installing it in the cramped space under the building structure. This means that the foundation plate connector must be easily adapted to installations of differing dimensions.

U.S. Pat. No. 1,078,142, granted Nov. 11, 1913, to Charles Harlen, teaches a device for anchoring structures to a concrete base that can be adjusted to allow for shrinkage of the structure anchored thereby. However, U.S. Pat. No. 1,078,142 is not suitable for retrofit work as the invention teaches that the foundation fastener means should project above the top of the upper surface of the foundation.

U.S. Pat. No. 5,072,570, granted Dec. 17, 1991 to Michael. Johnson, teaches a method for anchoring an existing wood frame building to its foundation with elongated truss members. Requiring the use of elongated truss members limits the application of this patent to foundations where access to the frame member and foundation is unhindered. Furthermore, to accommodate installations where the side face of the frame member, such as the sill plate, does not align with the side face of the foundation member, the installer must custom fashion either an additional framing member or plate to span the distance between the elongated truss member attached to the side face of the foundation and the side face of the frame member.

Harlen Retrofit Foundation System, U.S. Pat. No. 5,513,476, teaches a method for anchoring an existing wood frame building to its foundation with small, adjustable sheet metal connectors. The Harlen device achieves an adjustable connector by having two attachment members that slide in relation to each other and attach by inserting a held-holding fastener means into a discrete selected opening among a plurality of discrete openings. The fact that these openings receive the held-holding fastener means in close registration and the fact that they occur at various positions on both the frame attachment member and the foundation attachment member makes adjustment of the sheet metal connector difficult, especially when in a cramped space.

For example, in Harlen, the workman must align his top and bottom plates so that out of the twenty eight (28) openings in the upper plate, only two of them will be in alignment with two out of the six holes in the bottom plate.

Fitting two bolts into the two openings which are in alignment is not too difficult when you can look down upon the top plate and can see which holes are in alignment. Consider, however, how difficult this task is when there is not enough room as illustrated in FIG. 2 to get your head between the top of the foundation 2, the subfloor 45 resting on ledger board, and the floor joists 46. In this situation, the workman cannot see which two openings are in alignment, so he must find the proper hole out of fourteen (14) different holes by actually trying them one at a time. After he finds matching holes, he must then repeat the process in the other fourteen (14) holes. Playing this adult version of a game we all played in kindergarten by a workman for several days in a dark and dirty crawl space could drive a good man to strong drink.

The Harlen device also can not be used in installations where the frame member substantially overhangs the side surface of the foundation.

SUMMARY OF THE INVENTION

The purpose of the present invention is to easily and economically form a strong connection between a frame member of a completed building structure and the foundation on which it rests.

An object of the present invention is to use an anchoring means inserted in the side face of the foundation, thus providing a strong anchor that can be easily installed.

A further object of the present invention is to use a foundation plate connector that has a single member rather than multiple members as disclosed in the prior art.

Another object is to attach the connector to the sill plate member by a fastener such as a lag screw that may be inserted into the face 7 of the sill plate 5 along a horizontal plane.

A further object is to attach a connector to the foundation and frame member using standard fasteners and standard flat washers.

DESCRIPTION OF THE INVENTION

Figure 1:
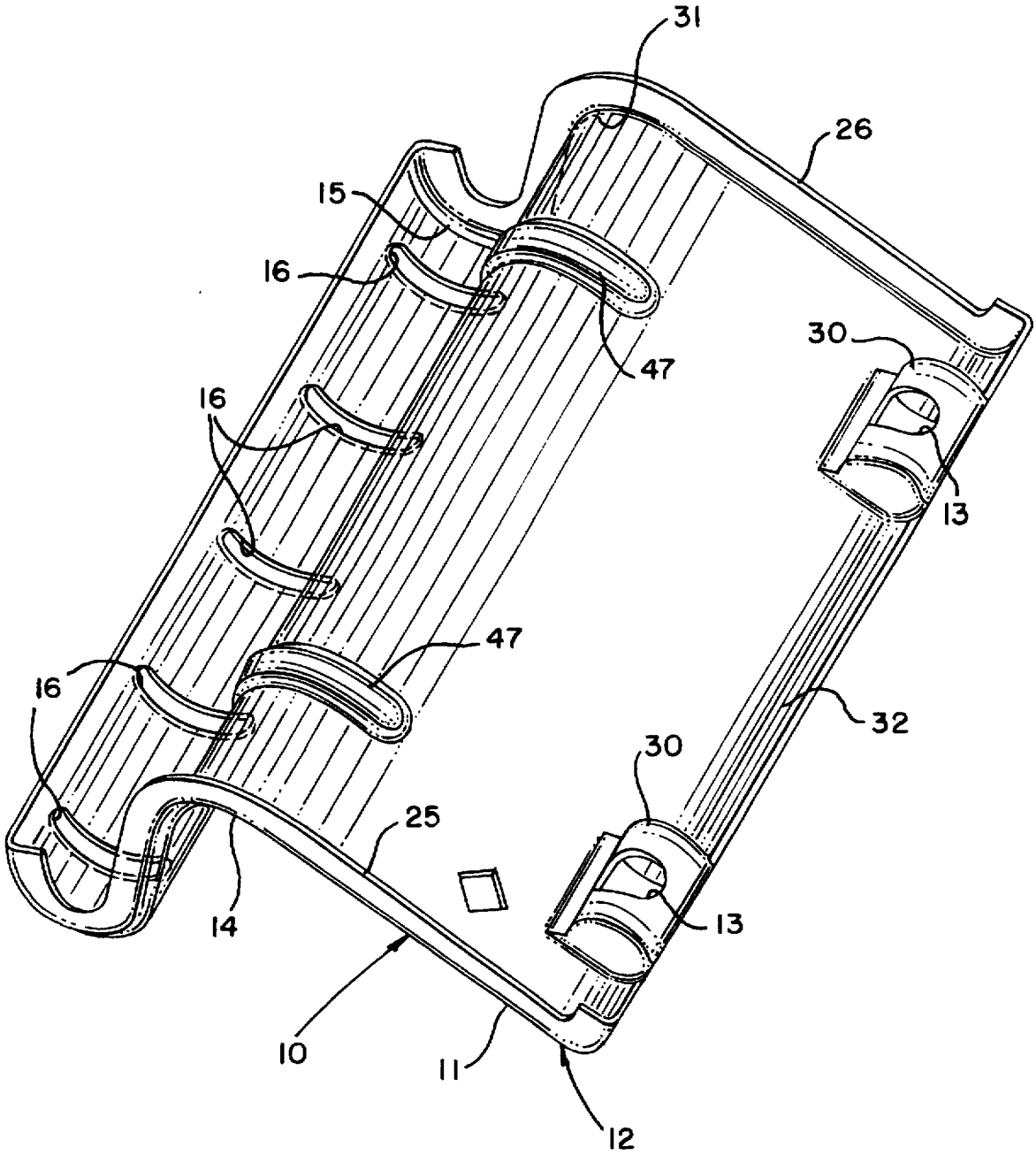
FIG. 1 is a perspective view of the foundation to frame connector of the present invention.

The one piece foundation-to-frame member connection 1 of the present invention consists of a foundation 2, having an upper surface 3, and a side surface 4; a frame member 5, having an upper side 6, an inside edge 7, and a lower side 8, resting on the upper surface 3 of the foundation 2; a one piece foundation to frame connector 10 having: a foundation attachment section 11 having a foundation attachment base 12 which is formed with foundation attachment opening means 13 and which is formed for substantial registration with the side surface 4 of the foundation 2; a frame attachment section 14 integrally and angularly connected to the foundation attachment section 11 and having a frame attachment base 15, the frame attachment base 15 being formed with frame attachment opening means 16, the frame attachment base 15 being in registration with the inside edge 7 of the frame member 5; frame fastener means 20 (indicated by arrows 20 in FIG. 2) for insertion through the frame attachment opening means 16 into the inside edge 7 of the frame member 5; and foundation fastener means 21 for insertion through the foundation attachment opening means 13 and the foundation 2.

Figure 2:
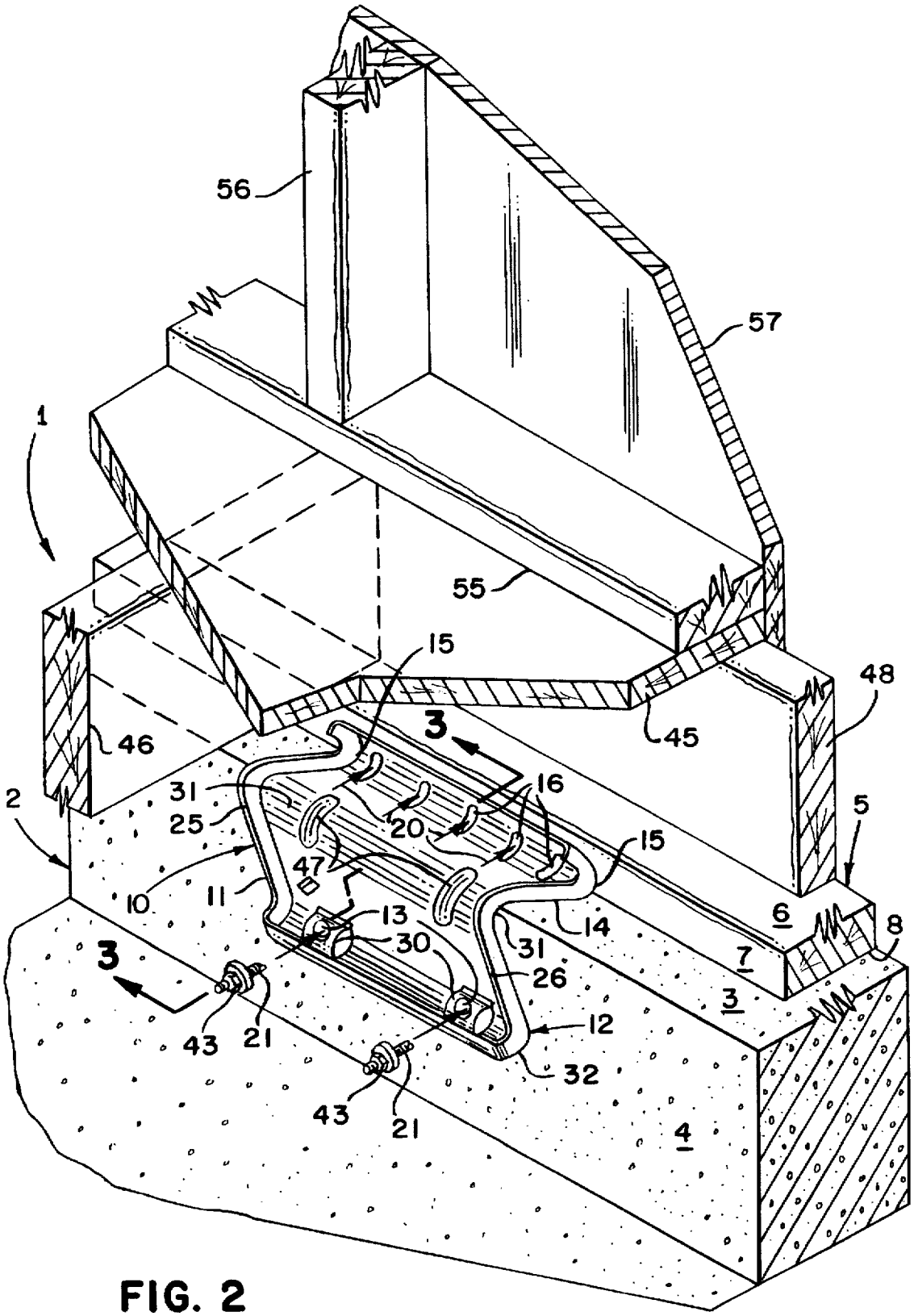
FIG. 2 is a perspective view of the connection of the present invention showing the crammed space in which the device must often be installed.

Referring to FIG. 2, the connector 10 is shown in a common environment with a floor plate 55 resting on subfloor 45 which in turn is connected to header 48. Wall studs 56 are attached to the floor plate 55 and sheathing 57 is affixed to the wall studs 56. Referring to FIGS. 1–7, a preferred form of the invention is illustrated in which the connection 1 as previously described and shown in the drawings is preferably constructed so that the foundation attachment opening means 13 are formed to permit insertion of the foundation fastener means 21 at a plurality of angles relative to the one piece foundation to frame connector 10.

Figure 7:
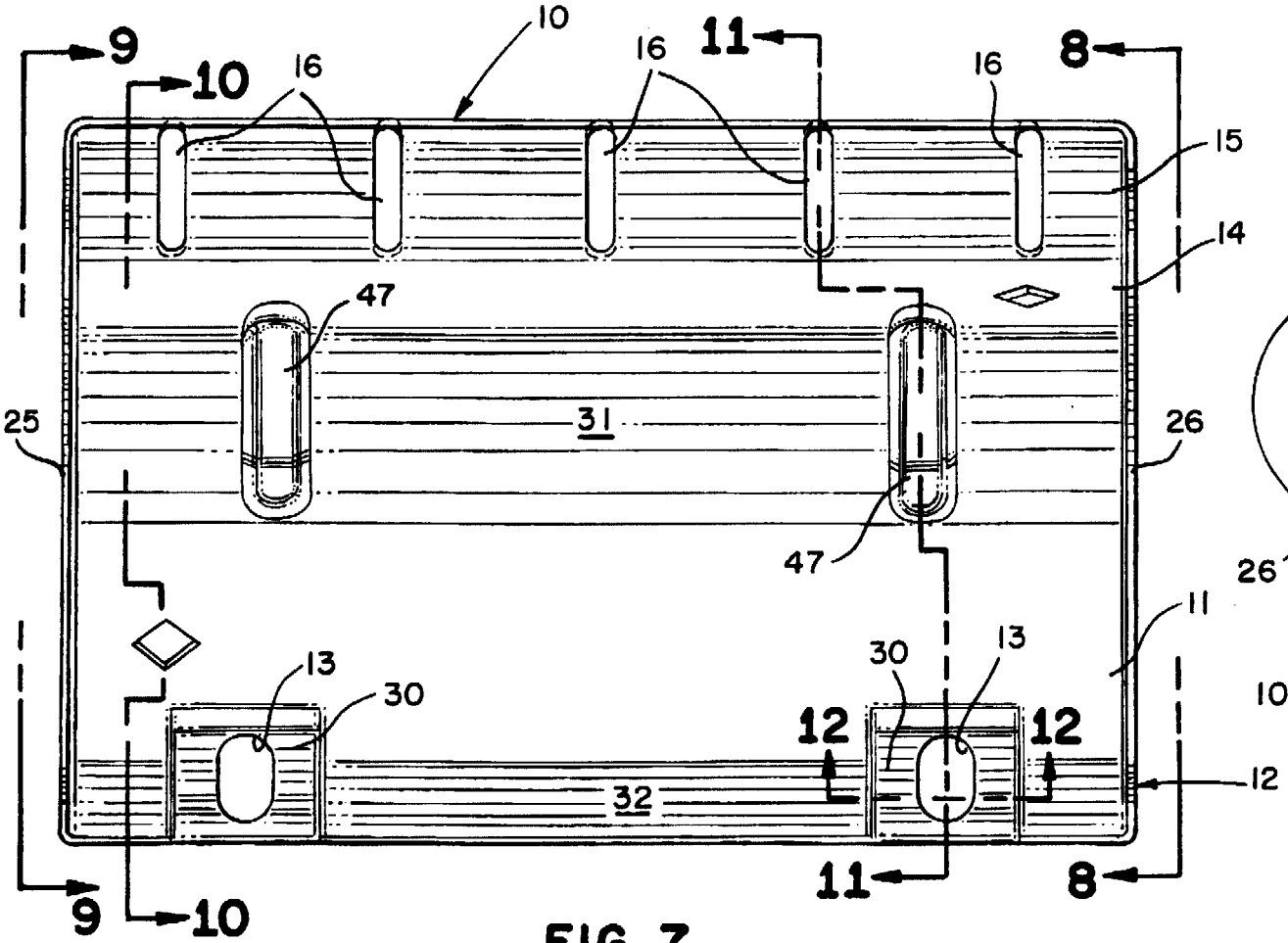
FIG. 7 is a top plan view of the connector of the present invention.
Figure 11:
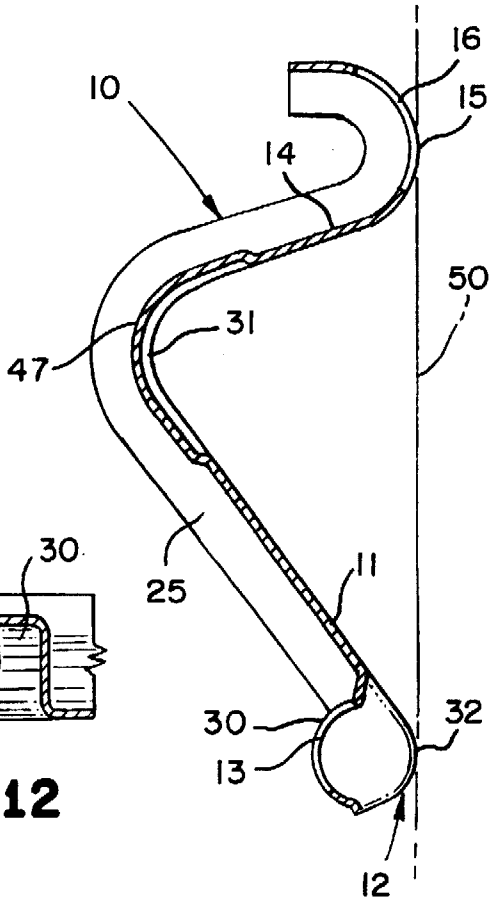
FIG. 11 is a cross sectional view of the connector shown in FIG. 7 taken along line 11—11 and placed on reference line 50.
Figure 12:
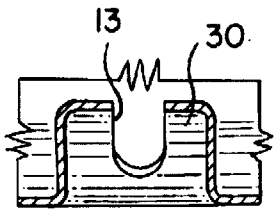
FIG. 12 is a cross sectional view of a portion of the connector shown in FIG. 7 taken along line 12—12.
Figure 10:
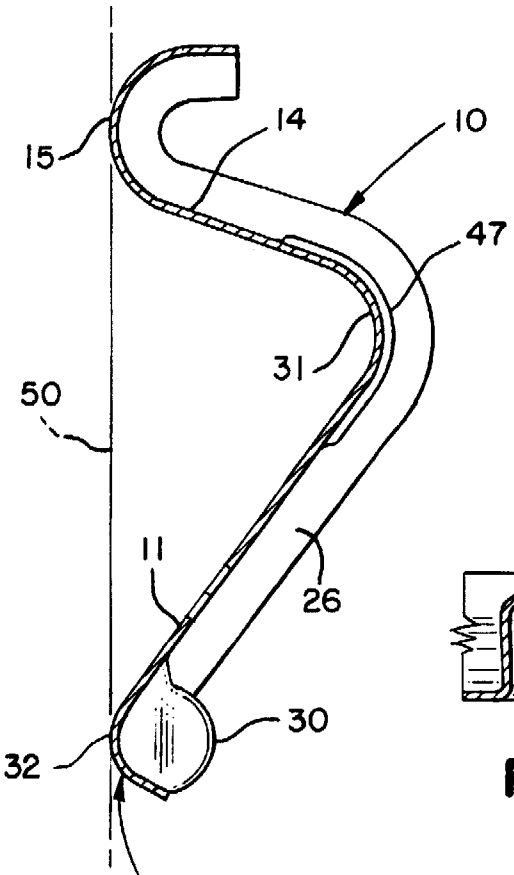
FIG. 10 is a cross sectional view of the connector shown in FIG. 7 taken along line 10—10 and placed on reference line 50.
Figure 9:
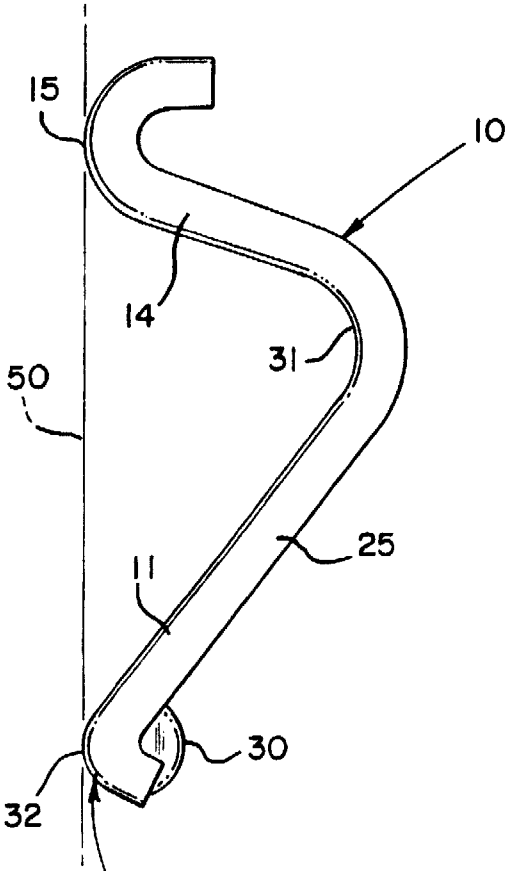
FIG. 9 is a side view of the connector shown in FIG. 7 taken along line 9—9 and placed on reference line 50.

In a further preferred form connection 1 as previously described is constructed so that the frame attachment opening means 16 are formed to permit insertion of the frame fastener means 20 at a plurality of angles relative to the one piece foundation to frame connector 10. As best shown in FIG. 7, the foundation attachment opening means 13 is formed in the shape of an obround opening. As best shown in FIGS. 1, 2 and 7, the frame attachment opening means 16 is formed in the shape of an obround opening.

Preferably, in the connection 1 as previously described the frame attachment base 15 is formed in the shape of a curve. It is also preferred that in the connection 1 as previously described, the foundation attachment base 12 is formed in the shape of a curve.

To strengthen the connection as previously described, the one piece foundation to frame connector 10 is formed with side flanges 25 and 26.

Figure 3:
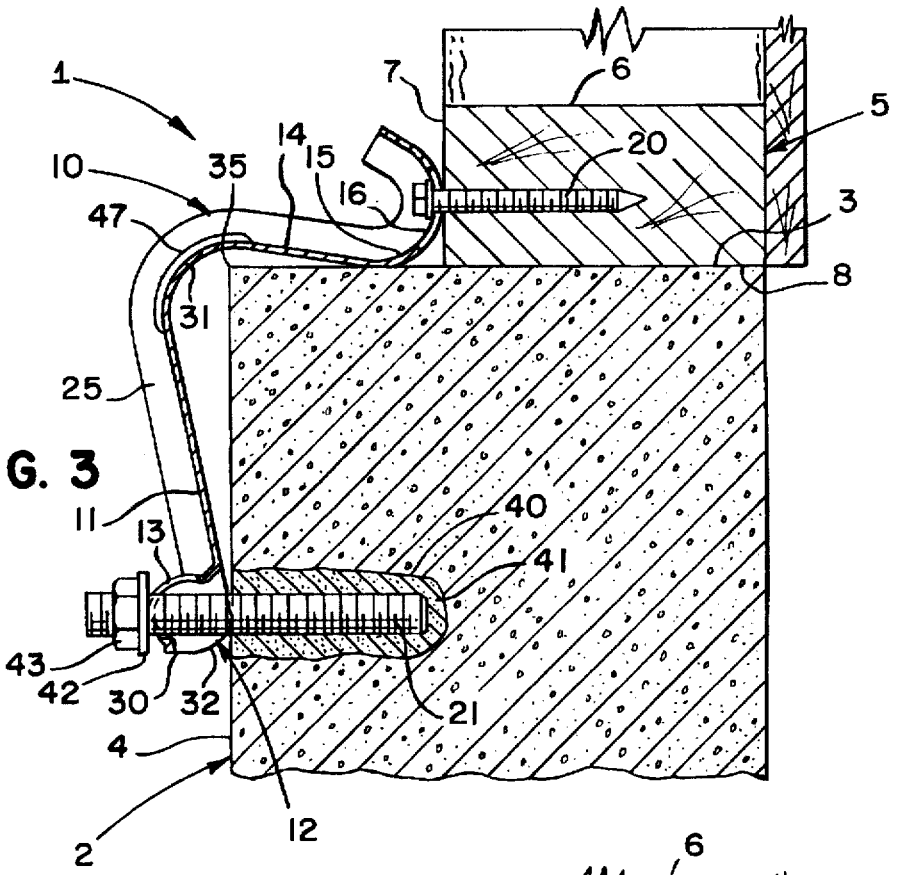
FIG. 3 is a cross sectional view of the connection taken along line 3—3 of FIG. 2 with connector 10 in a standard installation position.

Referring to FIG. 3, a typical installation of the connection 1 of the present invention is illustrated. As shown, the inside edge 7 of the frame member 5 is offset from the side surface 4 of the foundation 2. A feature of the present invention is the fact that the connection 1 may be made no matter whether the offset is a fraction of an inch or up to several inches. Early prototypes have achieved satisfactory results when the offset has been up to 2½". All the more remarkable, is the fact that the connection 1 may not only be accomplished with a single member, instead of 2 or more pieces as required by the prior art, but that the connection 1 may be made at infinite offset dimensions instead of the incremental offsets required by the prior art devices.

Figure 4:
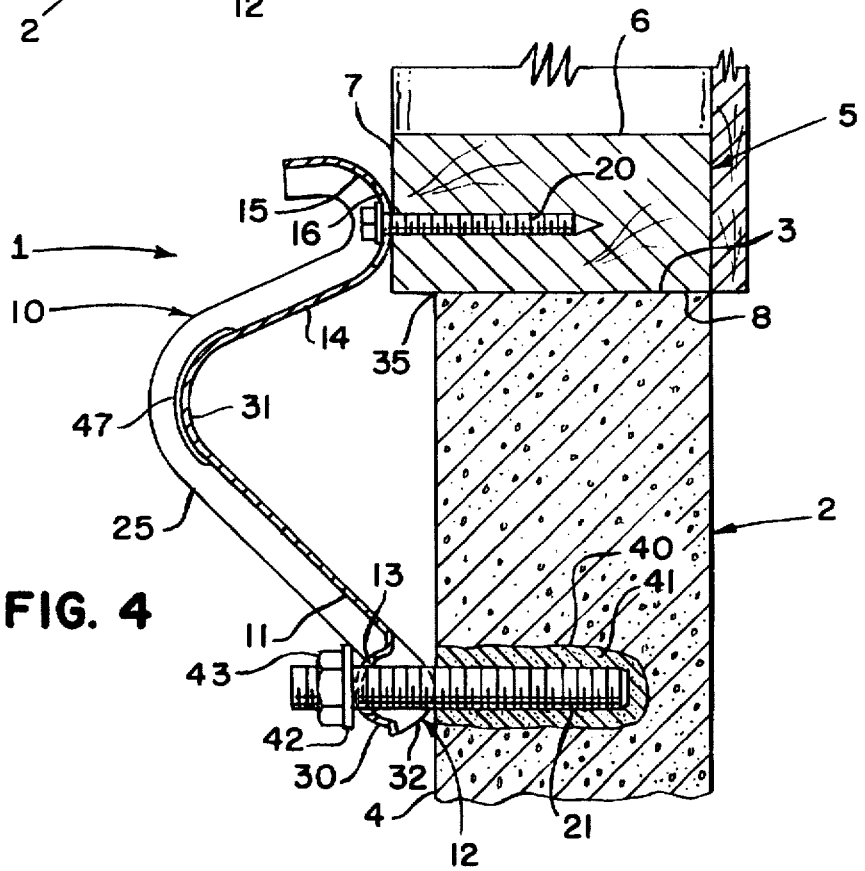
FIG. 4 is a cross sectional view of a connection similar to that shown in FIG. 3 as though taken along line 3—3 of FIG. 2, but with the sill plate overlapping the edge of the foundation plate instead of being correctly installed as in FIG. 3.

Referring to FIG. 4, another feature of the present connection 1 as previously described is the fact that the connection may be made even though the inside edge 7 of the frame member 5 overhangs the side surface 4 of the foundation 2. Again, connection 1 may be made by the retrofit installer even though the overhang is a fraction of an inch or more. Early prototypes have been able to give satisfactory results with as much as a ½" overhang. Furthermore, instead of the connection being made in incremental steps as is the case of prior art devices, the present connection 1 may be made in infinite dimensional overhangs.

Figure 5:
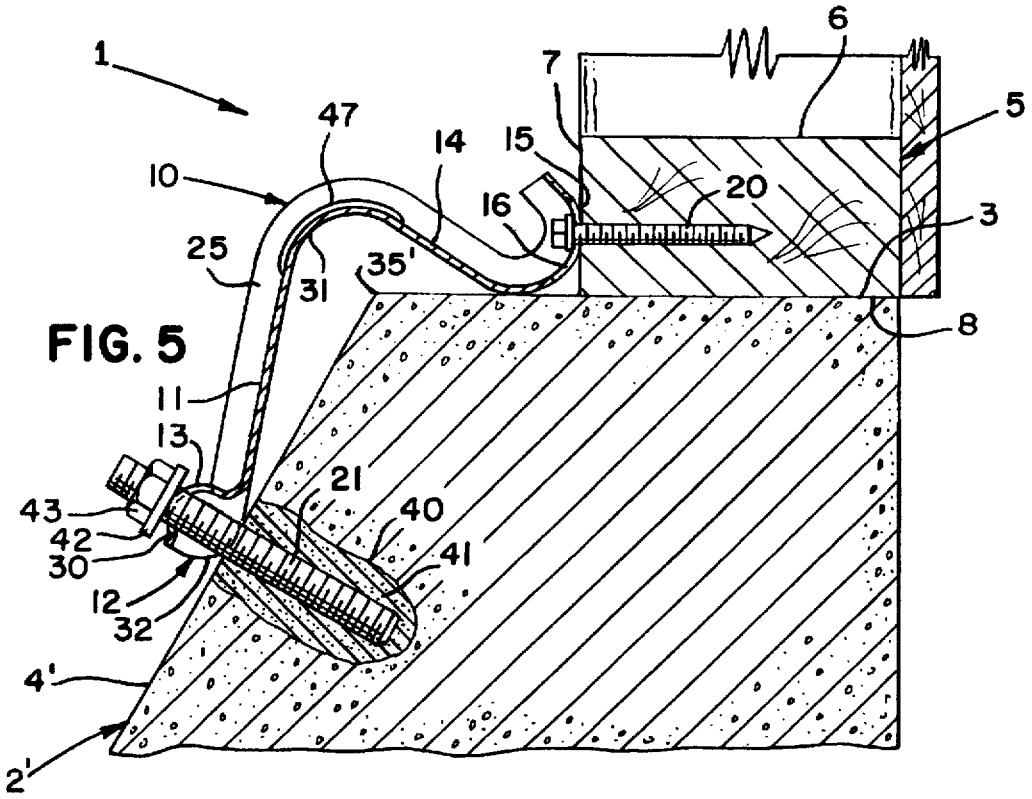
FIG. 5 is a cross sectional view of another installation using the same foundation to plate connector as shown in FIG. 1 with connector 10 in a different installation position. The installation is standard but the foundation inner face slopes. The cross section is taken along the same line 3—3 as shown in FIG. 2.
Figure 6:
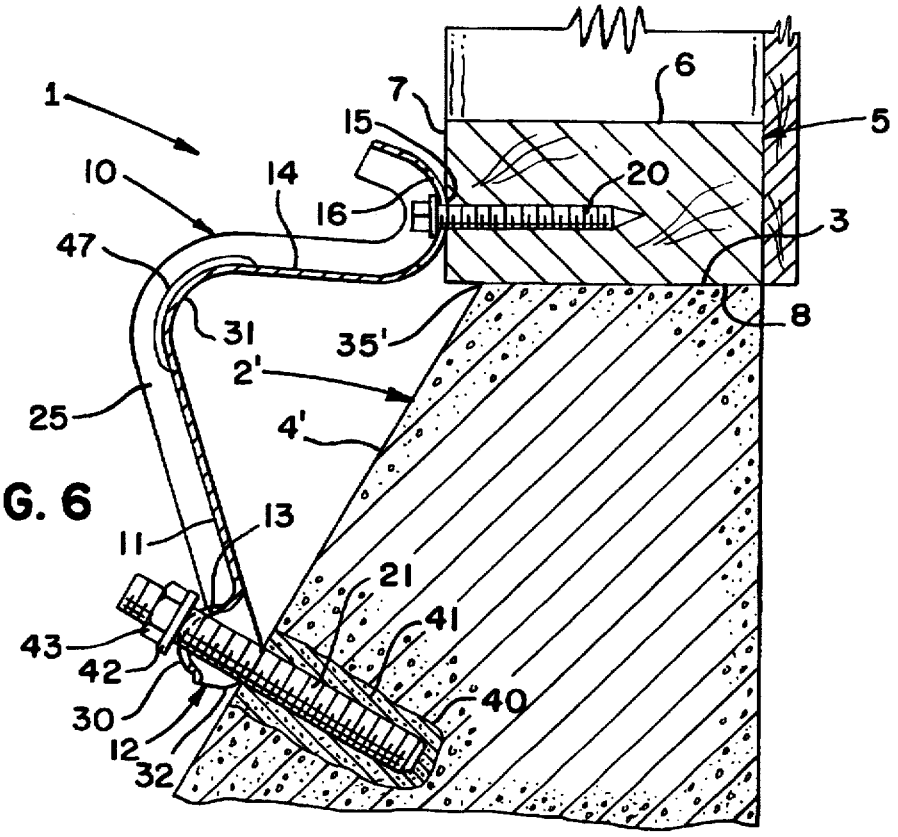
FIG. 6 is a cross sectional view of another installation using the same foundation to plate connector as shown in FIG. 1. The cross section is taken along the same line 3—3 as shown in FIG. 2. The installation is similar to the installation shown in FIG. 2 except that in FIG. 6 the sill plate extends beyond the edge of the foundation. The sill plate 5 is incorrectly installed, but is far too frequently seen in retrofit installations.
Figure 8:
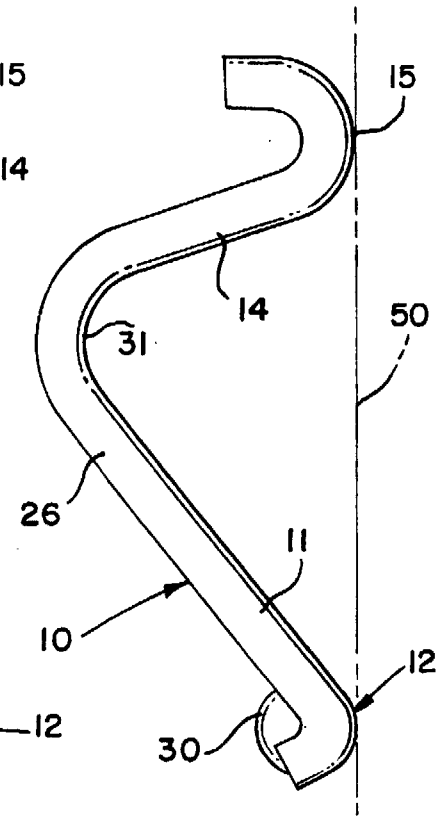
FIG. 8 is a side view of the connector shown in FIG. 7 taken along line 8—8 and placed on reference line 50.

Referring to FIGS. 5 and 6, it may be seen that the connection 1 of the present invention may be made even though the side surface 4' of the foundation 2' is formed at an angle to the inside edge 7 of the frame member 5. Thus the same one piece foundation to frame connector 10 may be used for slope side foundations as for vertical wall foundations.

As shown in FIG. 6, it may be seen that the one piece foundation to frame connector 10 may be used when the side surface 4' of the foundation 2' is formed at an angle to the inside edge 7 of the frame member 5 and the frame member 5 overhangs the inside edge 35 of foundation 2'.

As best seen in FIGS. 1, 3 and 4, the one piece foundation to frame connector 10 is preferably formed with a raised foundation base 30 integrally formed with the frame attachment base 15. This construction enables the foundation fastener means 21 such as a threaded bolt anchored in a drilled hole 40 filled with epoxy 41 either with a formed washer 42 or a loose washer to bear directly against the raised foundation base 30. This eliminates the need for a special convex type washer to interfit with the concave curved end section 32.

Preferably in the connection 1 as previously described the foundation attachment section 11 and the frame attachment section 14 are joined by a curved portion 31. Where strength is of the utmost importance, curved portion 31 provides this necessary strength, particularly with the side flanges 25 and 26 which are also curved.

Preferably, in the connection 1 as previously described, the foundation attachment section 11 is formed with a concave curved end section 32. This curvature enables the foundation attachment base 12 to form a tight fit with the side surface 4 of the foundation for all positions of the frame member 5 in relation to the side surface 4 of the foundation 2 regardless of whether the foundation is vertical as shown in FIGS. 3 and 4 or sloping as shown in FIGS. 5 and 6.

As best shown in FIGS. 3 and 4 as well as FIGS. 5 and 6, the raised foundation base 30 is formed with a convex curved portion 31 surrounding the foundation attachment opening means 13. This configuration provides the tightest fit between the washer 42 and the raised foundation base 30.

The connector 10 may be stiffened by means of forming elongated indentations 47 in the convex curved portion 31 of the connector 10.

OPERATION OF THE CONNECTION

Installation of the connection of the present invention, is set forth below.

First, assume that the frame member or sill plate 5 as shown in the most common situation is to be attached to the foundation 2 with the one piece foundation to frame connector 10, hereafter connector 10. The workman first decides where the connector 10 is to be located and places the connector on the foundation so that the frame attachment base is in contact with inside edge 7 of sill plate 5 and frame attachment opening means 16 are in registration with the inside edge 7 so that frame fastener means such as lag bolts 20 may enter at about the mid point of inside edge 7. The installer then marks the location of foundation attachment openings means 13 and drills holes into the concrete foundation 2. The drilled openings 40 (see FIGS. 3–6) are filled with epoxy 41, the threaded bolts inserted into the openings 40 and the epoxy is given time to harden. When the epoxy is sufficiently cured, the connector 10 is placed so that bolts 21 are inserted through foundation attachment openings means 13 and threaded nuts 43 are loosely threaded onto the bolts 21 to temporarily hold the connector 10. Next, frame attachment base 15 is set into place against inside edge 7 of frame member 7 and frame fastener means such as lag bolts 20 are inserted either by a power tool or by hand wrench. When the lag bolts 20 are fully installed, nuts 43 on foundation fastener means 21 are tightened down. Note that the connector 10 automatically adjusts itself to the final location by merely tightening the frame and foundation fastener means 20 and 21.

I claim:

1. A one piece foundation-to-frame member connection comprising:

a. a foundation, having an upper surface, and a side surface;

b. a frame member, having an upper side, an inside edge, and a lower side, resting on the upper surface of said foundation;

c. a one piece foundation to frame connector including, 1. a foundation attachment section having a foundation attachment base which is formed with foundation attachment opening means and which is formed for substantial registration with said side surface of said foundation 2. a frame attachment section integrally and angularly connected to said foundation attachment section and having a frame attachment base formed in the shape of a curve, said frame attachment base being formed with frame attachment opening means, said frame attachment base being in registration with said inside edge of said frame member;

d. frame fastener means for insertion through said frame attachment opening means into said inside edge of said frame member connecting said frame attachment section to said frame member; and e. foundation fastener means for insertion through said foundation attachment opening means and said foundation connecting said foundation attachment section to said foundation.

2. A one piece foundation-to-frame member connection comprising:

a. a foundation, having an upper surface, and a side surface;

b. a frame member, having an upper side, an inside edge, and a lower side, resting on the upper surface of said foundation;

c. a one piece foundation to frame connector including, 1. a foundation attachment section having a foundation attachment base which is formed in the shape of a curve and which is formed with foundation attachment opening means and which is formed for substantial registration with said side surface of said foundation 2. a frame attachment section integrally and angularly connected to said foundation attachment section and having a frame attachment base, said frame attachment base being formed with frame attachment opening means, said frame attachment base being in registration with said inside edge of said frame member;

d. frame fastener means for insertion through said frame attachment opening means into said inside edge of said frame member connecting said frame attachment section to said frame member; and e. foundation fastener means for insertion through said foundation attachment opening means and said foundation connecting said foundation attachment section to said foundation.

3. A one piece foundation-to-frame member connection comprising:

a. a foundation, having an upper surface, and a side surface;

b. a frame member, having an upper side, an inside edge, and a lower side, resting on the upper surface of said foundation;

c. a one piece foundation to frame connector including, 1. a foundation attachment section having a foundation attachment base which is formed with foundation attachment opening means and which is formed for substantial registration with said side surface of said foundation 2. a frame attachment section integrally and angularly connected to said foundation attachment section and having a frame attachment base, said frame attachment base being formed with frame attachment opening means, said frame attachment base being in registration with said inside edge of said frame member;

d. a raised foundation base integrally formed with said foundation attachment section for offsetting said foundation attachment opening means from said side surface of said foundation;

e. frame fastener means for insertion through said frame attachment opening means into said inside edge of said frame member connecting said frame attachment section to said frame member; and f. foundation fastener means for insertion through said foundation attachment opening means and said foundation connecting said foundation attachment section to said foundation.

4. A one piece foundation-to-frame member connection as described in claim 3 comprising:

a. said raised foundation base is formed with a convex curved portion surrounding said foundation attachment opening means.

* * * * *